US010018428B2

(12) United States Patent
Altman et al.

(10) Patent No.: US 10,018,428 B2
(45) Date of Patent: Jul. 10, 2018

(54) METHOD AND APPARATUS FOR HEAT SPREADERS HAVING A VAPOR CHAMBER WITH A WICK STRUCTURE TO PROMOTE INCIPIENT BOILING

(75) Inventors: David H. Altman, Framingham, MA (US); Joseph R. Wasniewski, Watertown, MA (US); Anurag Gupta, Canton, MA (US)

(73) Assignee: Raytheon Company, Waltham, MA (US)

( * ) Notice: Subject to any disclaimer, the term of this patent is extended or adjusted under 35 U.S.C. 154(b) by 1381 days.

(21) Appl. No.: 13/169,581

(22) Filed: Jun. 27, 2011

(65) Prior Publication Data

US 2012/0325439 A1 Dec. 27, 2012

(51) Int. Cl.
*F28D 15/04* (2006.01)
*F28F 21/08* (2006.01)

(52) U.S. Cl.
CPC ..... *F28D 15/046* (2013.01); *F28F 21/08* (2013.01); *F28F 21/084* (2013.01); *F28F 2255/18* (2013.01); *F28F 2255/20* (2013.01); *F28F 2265/26* (2013.01)

(58) Field of Classification Search
CPC ..... F28D 15/046
USPC ..... 165/104.26, 104.33
See application file for complete search history.

(56) References Cited

U.S. PATENT DOCUMENTS 6,397,935 B1 * 6/2002 Yamamoto et al. ..... 165/104.26
7,002,247 B2 2/2006 Mok et al.
7,180,179 B2 2/2007 Mok et al.
7,420,810 B2 9/2008 Reis et al.
7,609,520 B2 * 10/2009 Chang et al. ..... 361/700
7,732,918 B2 6/2010 Dangelo et al.
7,843,695 B2 11/2010 Yang et al.
2003/0141045 A1 * 7/2003 Oh et al. ..... 165/104.26
2005/0092467 A1 * 5/2005 Lin et al. ..... 165/104.26
2005/0139995 A1 * 6/2005 Sarraf et al. ..... 257/706
2006/0037737 A1 2/2006 Chen et al.
2006/0090885 A1 * 5/2006 Montgomery et al. .. 165/104.33
2007/0099311 A1 5/2007 Zhou et al.
2008/0053640 A1 3/2008 Mok
2008/0128116 A1 * 6/2008 Dangelo et al. ..... 165/104.21
2008/0225489 A1 * 9/2008 Cai et al. ..... 361/704
2008/0283222 A1 * 11/2008 Chang et al. ..... 165/104.26
2009/0056917 A1 * 3/2009 Majumdar et al. ..... 165/104.26
2009/0159243 A1 6/2009 Zhao et al.
2010/0294467 A1 * 11/2010 Varanasi et al. ..... 165/108
2013/0032311 A1 2/2013 Bhunia et al.

OTHER PUBLICATIONS

Faghri, "Heat Pipe Science and Technology", Published in 1995 by Taylor & Francis Group, ISBN 1-56032-383-3, (attaching *Heat Pipe Science and Technology Cover, Copyright Page, Referenced Page*), 3 pages.

(Continued)

*Primary Examiner* — Allen Flanigan

(74) *Attorney, Agent, or Firm* — Daly, Crowley, Mofford & Durkee, LLP

(57) ABSTRACT

Methods and apparatus for a heat spreader including a vapor chamber, a fluid in the vapor chamber, a wick disposed in the vapor chamber, the wick comprising a metal wick structure, and a coating on wick comprising carbon nanotubes for promoting incipient boiling of the fluid.

13 Claims, 10 Drawing Sheets

(56) References Cited

OTHER PUBLICATIONS

Zhao, Y and Chen, C. 2006, "An Investigation of Evaporation Heat Transfer in Sintered Copper Wicks With Microgrooves," Proceedings of IMECE 2006, 2006 ASME International Mechanical Engineering Congress and Exposition, Nov. 5-10, 2006, Chicago, IL, USA, 5 pages.
Semenic, T and Catton, I. 2006, "Heat Removal and Thermophysical Properties of Biporous Evaporators," Proceedings of IMECE 2006, 2006 ASME International Mechanical Engineering Congress and Exposition, Nov. 5-10, 2006, Chicago, IL, USA, 7 pages.

* cited by examiner

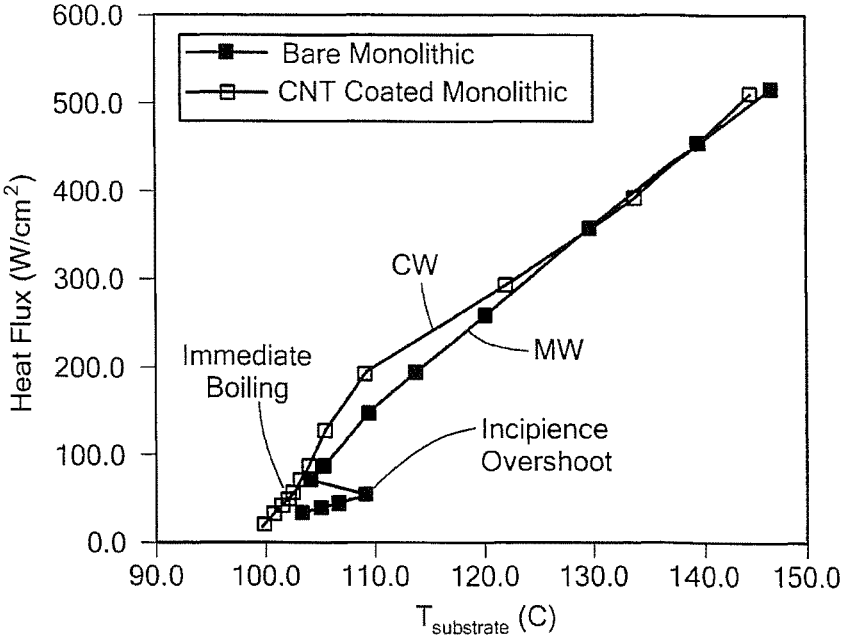
*FIG. 3C*
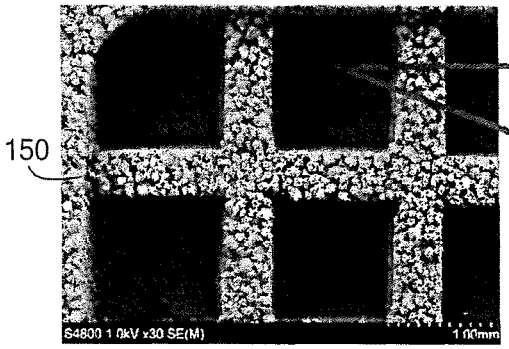
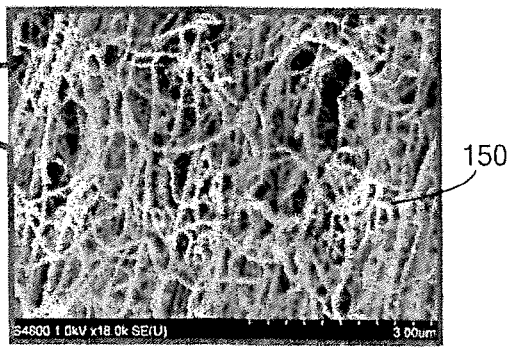
*FIG. 3D* *FIG. 3E*

METHOD AND APPARATUS FOR HEAT SPREADERS HAVING A VAPOR CHAMBER WITH A WICK STRUCTURE TO PROMOTE INCIPIENT BOILING

STATEMENT REGARDING FEDERALLY SPONSORED RESEARCH

This invention was made with government support under Contract No. N66001-08-C-2011, awarded by the DARPA. The government has certain rights in this invention.

BACKGROUND

As is known in the art, electronics packages typically require heat dissipation for integrated circuits, which can generate significant amounts of heat. A wide range of mechanisms for dissipating heat are well known, such as fans, heat fins, liquid cold plates, heat pipes, and the like. As advances in microelectronics occur, devices generate ever more heat, and as a result, more efficient cooling solutions are required.

One mechanism for the efficient transportation of heat away from high-dissipation electronics packages is a closed, two-phase heat pipe or vapor chamber system. Prior attempts to employ vapor chamber heat spreaders for cooling high heat flux electronics suffer from a fundamental tradeoff between mass transport within and thermal resistance of the wick. Thick wicks allow sufficient liquid transport to the heated area, but also increase the thermal resistance associated with the evaporator. Many configurations have been used in an attempt to address this limitation via fluid delivery from above or below the wick with arteries, or bi-porous "clumps" of material with smaller features; neither are ideal for thickness-constrained heat spreaders cooling high heat flux devices. The former solution increases the conduction resistance associated with transporting heat to the liquid-vapor interface, while the latter reduces the available vapor transport space for a given heat spreader thickness, which in turn limits total heat transport capability.

SUMMARY

The present invention provides methods and apparatus for a heat spreader having a wick structure to promote boiling for efficient heat transfer. Exemplary embodiments of the invention induce boiling under the application of lower heat density conditions than it would occur in conventional wick materials by the application of nano-functionalization, which refers to the fabrication of a nanomaterial on the surface of a wick. This manipulation of the heat transfer mechanism within the wick structure allows simultaneous achievement of low thermal resistance and high mass transport. This advancement represents a significant step forward in the use of nano-structured materials in vapor chambers. Exemplary embodiments of the invention do not rely on using significant amounts of fragile and often chemically incompatible nanomaterials to serve the primary wicking function. Nanomaterials refer to materials with morphological features on the nanoscale, and particularly materials that have special properties stemming from their nanoscale dimensions. As used herein, nanoscale is defined as smaller than a one tenth of a micrometer in at least one dimension. The nanoscopic scale is roughly a lower bound to the mesoscopic scale for most solids.

It is understood that particularly for relatively small, high heat flux devices, such as power amplifier devices in radar system transmit/receive modules, the power at which such devices can be operated may be limited by the ability to cool the device. For example, conventional heat spreaders limit the amount of power that can be transmitted by a radar antenna due to the cooling limitations of the transmit/receive modules. Exemplary embodiments of the invention enable higher power levels to be used when transmitting signals, for example.

In addition, inventive vapor chamber embodiments are constructed using coefficient of thermal expansion (CTE)-matched materials to enable direct-attach of III-V RF semiconductors, such as GaAs, GaN, etc., to further minimize package thermal resistance by avoiding the need for lower-performing compliant thermal interface materials (TIMs). The materials used to construct the vapor chamber are inherently compatible with hermetic RF module construction, enabling application to thermally challenging next-generation RF electronics.

In one aspect of the invention, a heat spreader system comprises a vapor chamber, a fluid in the vapor chamber, a wick disposed in the vapor chamber, the wick comprising a metal wick structure, and a coating on wick comprising carbon nanotubes for promoting incipient boiling of the fluid.

The heat spreader system can further comprise one or more of the following features: a frame, a cover and a base, wherein the frame is formed from a first material having a first coefficient of thermal expansion (CTE) and the cover is formed form a second material having a second CTE, wherein the first CTE is greater than a reference CTE and the second CTE is less than the reference CTE, the frame comprises copper, the cover comprises a multi-layer laminate, the laminate layers comprise a first or top layer comprising copper, a middle or second layer comprising molybdenum, and a third or bottom layer comprising copper, the vapor chamber has a composite CTE matched to a CTE of a substrate for circuitry, the CTE of the substrate corresponds to GaAs, the wick is bi-porous, the wick comprises sintered copper particles, and interior surfaces of the vapor chamber are copper.

In another aspect of the invention, an assembly comprises: a heat spreader including a vapor chamber, a fluid in the vapor chamber, a wick disposed in the vapor chamber, the wick comprising a metal wick structure, and a coating on the wick comprising carbon nanotubes for promoting incipient boiling of the fluid, and a module containing a semiconductor die having circuitry in thermal communication with the vapor chamber.

The assembly can further comprise one or more of the following features: the module comprises a hermetically sealed package, the module comprises a transmit/receive module, the die comprises GaAs, the heat spreader has a composite CTE matched to the GaAs die, and the heat spreader includes at least one internal structural post to react to internally generated pressures.

In a further aspect of the invention, a system comprises a heat spreader, including a vapor chamber, a fluid in the vapor chamber, a wick disposed in the vapor chamber, the wick comprising a metal wick structure, and a coating on the wick comprising carbon nanotubes for promoting incipient boiling of the fluid, and a module containing a semiconductor die having circuitry in thermal communication with the vapor chamber.

The system can further include one or more of the following features: the system comprises a radar system, the module comprises a transmit/receive module, and the die comprises GaAs or GaN.

BRIEF DESCRIPTION OF THE DRAWINGS

The foregoing features of this invention, as well as the invention itself, may be more fully understood from the following description of the drawings in which:

FIG. 3C is graphical representation of a notional vapor chamber with an ideal transition from evaporation to boiling;

FIG. 3D is a pictorial representation of magnified carbon nanotube growth;

FIG. 3E shows further magnification of the carbon nanotube growth of FIG. 3D;

DETAILED DESCRIPTION

Figure 1:
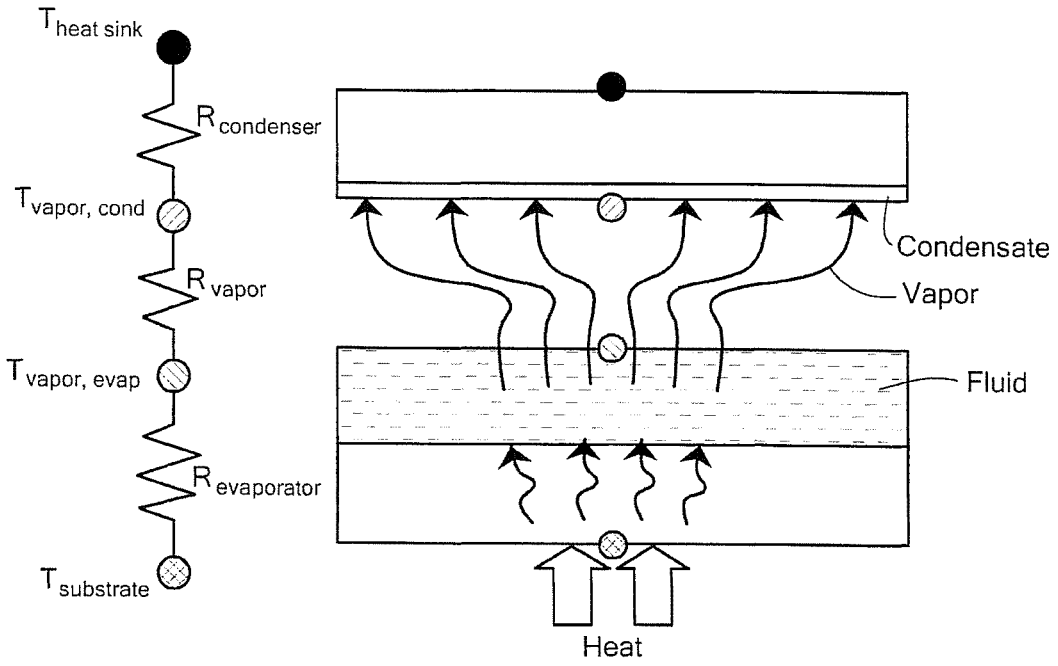
FIG. 1 is a schematic representation of thermal resistances for a vapor chamber.

The present invention provides methods and apparatus suited for spreading heat from high-flux electronics in an electronics module. The need for enhanced heat spreading is particularly profound in advanced devices where the dissipated heat fluxes are driven well over 100 W/cm$^2$, for example. Exemplary embodiments of the invention provide a low thermal resistance, coefficient of thermal expansion (CTE)-matched multi-chip vapor chamber heat spreader, which can be integrated to create a hermetically sealed RF module with capillary driven two-phase heat transport to spread heat.

In one embodiment, a vapor chamber combines sintered copper powder and nanostructured materials in the vapor chamber wick to achieve low thermal resistance for cooling of high heat flux devices. In one particular embodiment, vertically aligned carbon nanotubes can be selected for the nanostructure. A low-profile vapor chamber is constructed with materials that are fully compatible with RF module manufacturing and are CTE-matched with the semiconductor of interest to enable integration of these thin vapor chambers into hermetic packages and low resistance die attach.

Vapor chambers reduce the temperature drop associated with spreading heat from a small, high heat flux source to a larger heat sink area by transporting the heat through movement of vapor. The improvement relative to a solid spreader is typically dictated by the evaporator performance at the design operating point. In accordance with exemplary embodiments of the invention, by adding nanostructure (via nanoscale coatings, such as carbon nanotube films) one can induce incipient boiling (point at which boiling instantaneously takes over as the dominant heat transfer mechanism) within the wick structure at a lower superheat (wall minus vapor temperature) and saturation temperature (vapor temperature) than it would otherwise occur in a conventional wick structure.

Once boiling is initiated, a 'thermal short' is effectively created between the vapor chamber wall and vapor cavity that effectively eliminates the thermal resistance associated with conduction through the water-filled wick during typical evaporation-dominated conditions. This significantly improves the performance of the evaporator at a design point that would otherwise offer sub-optimal and/or undesirable performance. Exemplary embodiments of the invention utilize meso-scale features on wick materials (over which the nano-functionalization is applied) engineered for mass transport to facilitate improved vapor escape and reduced thermal resistance under boiling conditions.

Before describing exemplary embodiments of the invention, some information is provided. Effective heat spreading affords system designers flexibility in selection of heat sinks and reduces the cost, size, weight and complexity associated with removal of heat from the electronics package. For many microelectronic packages, solid low CTE materials, such as CuMo (copper-molybdenum alloy), are used to both provide mechanical support and heat spreading for microelectronics devices. While these heat spreading substrates are relatively robust and reliable, they are also limited in heat spreading performance.

Heat pipes and vapor chambers are alternatives to solid conductor heat spreaders. These devices contain a porous wicking material and discrete evaporator and condenser sections, using primarily capillary-driven liquid transport (rather than conduction) to spread dissipated heat with minimal temperature drop. For microelectronics packages with small, high-heat devices and relatively large heat sinking areas, conventional vapor chambers (flat heat pipes) can provide acceptable thermal performance. However, attention must be paid to the component thermal resistances that determine the overall temperature drop for a given heat input and heat sinking geometry.

As shown in FIG. 1, overall thermal resistance in vapor chamber heat spreaders includes three primary component resistances: 1) evaporator resistance $R_{evaporator}$, 2) vapor transport (pressure loss) resistance $R_{vapor}$, and 3) condenser resistance $R_{condenser}$. Conventional designs attempt to minimize evaporator and condenser thermal resistances $R_{evaporator}$, $R_{condenser}$ while ensuring the mass transport requirements to support a specified heat load can be met. For example, patterning of traditional sintered materials to enhance vapor transport has been used with some success. Bi-porous structures, which have both larger and smaller pores, have been tried as a means to enhance liquid transport. Super-hydrophobic surfaces have been used to promote dropwise condensation. Nanostructured materials have also been investigated to reduce evaporative resistance via implementation of two-dimensional micro/nanowick patterns.

However, these heat spreaders may not be sufficient for relatively small high flux devices due to operating condition-based or material- and construction-related limitations.

Figure 2:
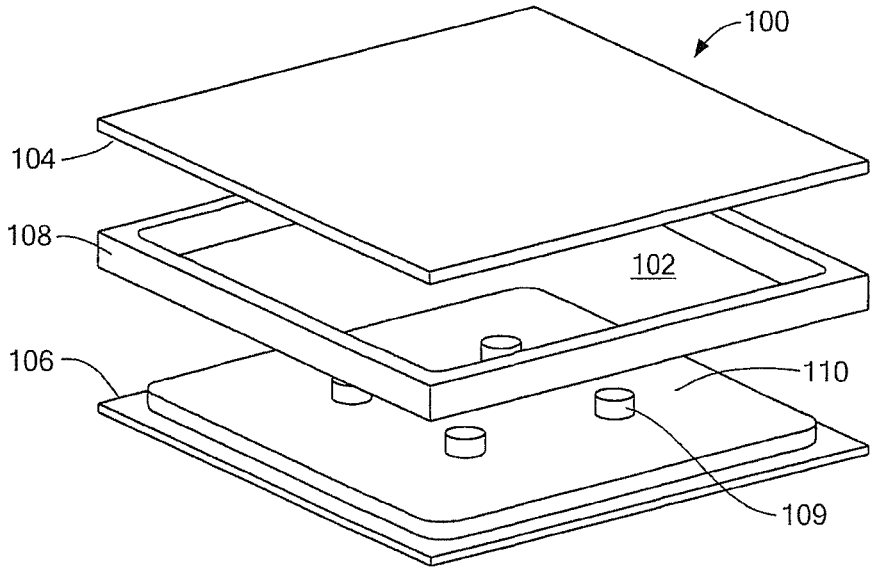
FIG. 2 is an exploded schematic representation of a heat spreader having a wick coated with carbon nanotubes in accordance with exemplary embodiments of the invention.

FIG. 2 shows an exemplary heat spreader 100 having a vapor chamber 102 defined by opposing substrates 104, 106 and a frame 108. In one embodiment, the frame 108 comprises copper and the substrates 104, 106 comprise Cu/Mo/Cu. Posts 109 can be provided for structural stability. A wick 110 coated with carbon nanotubes is disposed in the chamber 102 to move the fluid to the heat input, as described more fully below. The wick 100 can be structured to promote vapor escape, as described more fully below. It is understood that by changing the percentages of Cu and Mo one can manipulate the coefficient of thermal expansion from ~5 ppm/K to that of Cu (~16 ppm/K). By using a Cu frame, the effective CTE of the assembly is the result of the Cu/Mo/Cu laminate covers "pulling" on the Cu frame as it tries to expand. Thus, the composite CTE can be tailored by controlling the design of the Cu frame and thickness of the Cu/Mo/Cu covers (thickness and X-Y size) to act against thermal expansion.

Figure 2A:
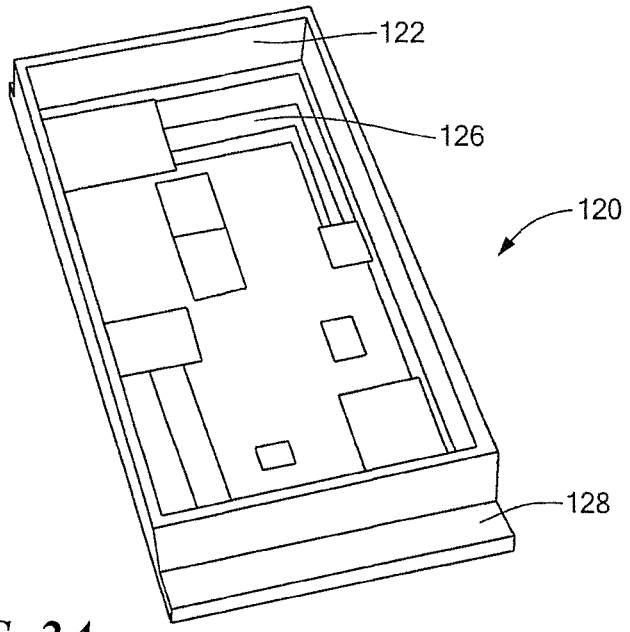
FIG. 2A is a pictorial representation of an assembly including an RF module in thermal communication with a heat spreader.
Figure 2B:
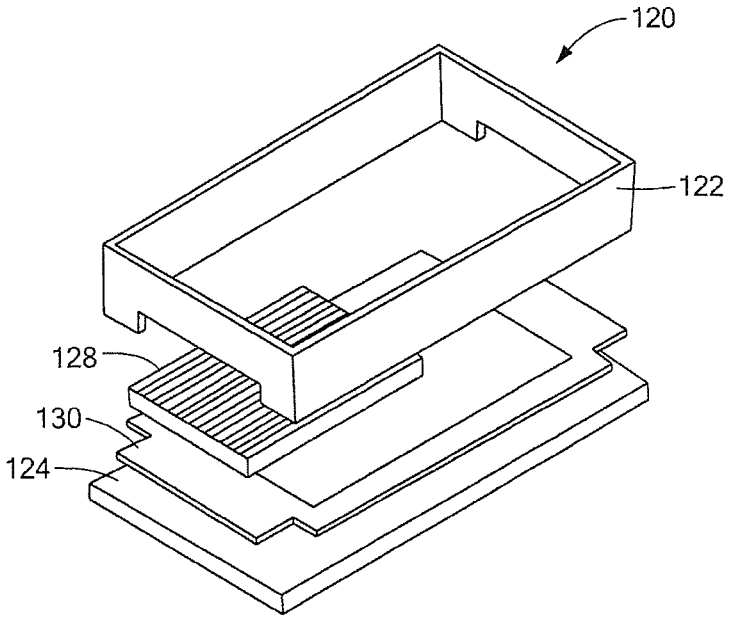
FIG. 2B is an exploded schematic representation of a portion of an assembly having a heat spreader.

FIGS. 2A and 2B show an exemplary electronics package 120 in thermal communication with a vapor chamber heat spreader having a wick coated with carbon nanotubes (not shown) in accordance with exemplary embodiments of the invention. A module casing 122 is secured to a Cu/Mo layered base 124. In an exemplary embodiment, the package 120 includes circuitry for an RF transmit/receive module 126 and is hermetically sealed. The package 120 includes RF and DC signal feedthroughs 128 and a solder preform 130 to provide electrical connections with the module circuitry.

Figure 2C:
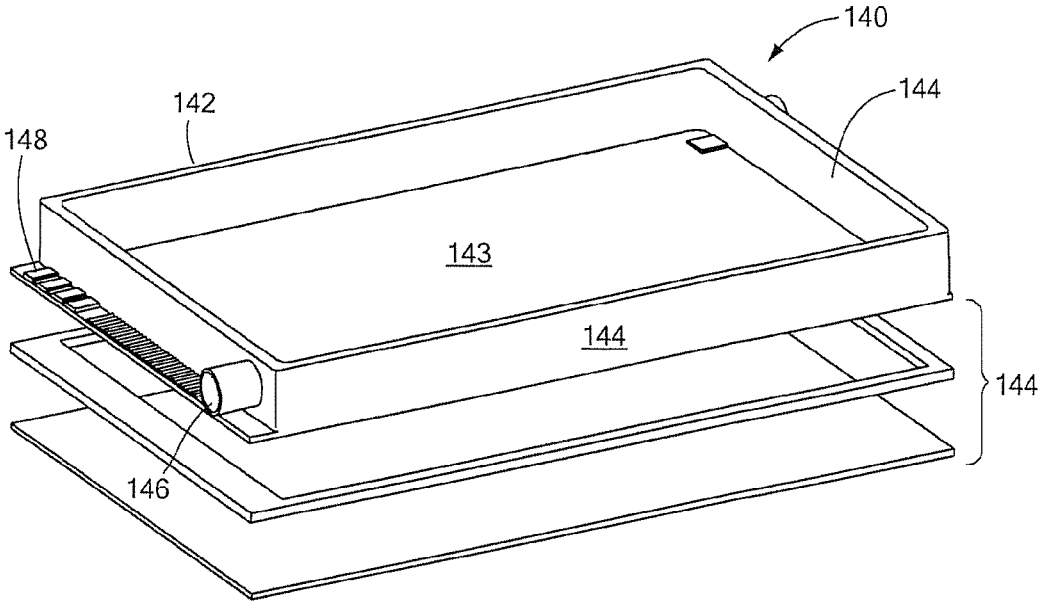
FIG. 2C is an exploded schematic representation of a portion of an assembly having a heat spreader.
Figure 2D:
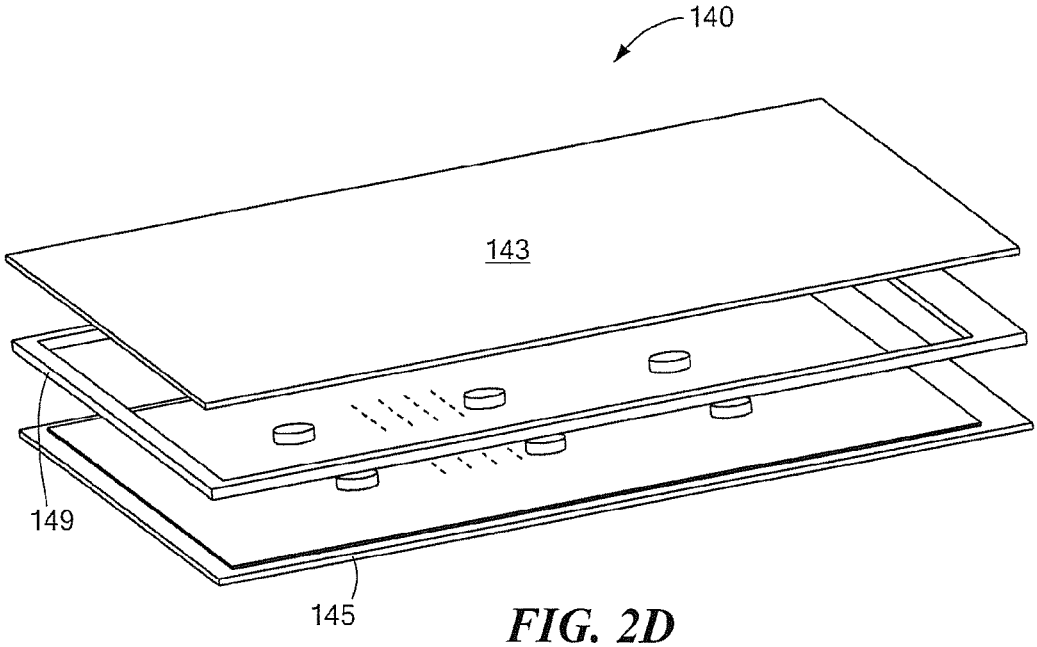
FIG. 2D is an exploded schematic representation of a portion of an assembly having a heat spreader.

FIGS. 2C and 2D show a further embodiment of an assembly 140 including a casing 142 for an electronics module coupled to a vapor chamber heat spreader 144 with a wick 145 coated with carbon nanotubes in accordance with exemplary embodiments of the invention. The casing 142 includes walls 144 and base 143 that can be hermetically sealed, a hermetically integrated RF interconnect 146, and hermetically integrated signal feedthroughs 148. The vapor chamber 144 includes a bottom 147 and cover 143 (base of casing 142) secured to a frame. In one embodiment, the bottom 147 and cover/base 143 are formed from a Cu/Mo/Cu laminate that provides an all copper interior surface for the vapor chamber.

It is understood that the geometry and dimensions of the components and package can vary to meet the requirements of a particular application. In one embodiment, the package 140 is about 1.35 inches wide, about 2.11 inches long and about 0.2 inch thick.

Exemplary embodiments of the vapor chamber heat spreader provide effective heat spreading while maintaining compatibility with hermetic module construction requirements. In one embodiment, a composite construction comprises low CTE face sheets, such as Cu/Mo/Cu or Cu/Invar/Cu, and a high CTE Cu frame. By adjusting the composition and thickness of the face sheets and geometry of the frame, the effective CTE of the assembled substrate can be tuned to match a target CTE between the CTEs of the constituent materials. In general, with regard to a reference CTE, the frame has a CTE higher than the reference CTE and the base and cover have a (composite) CTE that is lower than the reference CTE.

Expansion of the Cu frame is resisted by the Cu/Mo/Cu or Cu/Invar/Cu face sheets, thereby restricting deformation in accordance with the elastic properties of the material. Also, the inherent symmetry of the package enables the fabrication of very flat substrates, which facilitates bonding of the ring frame and subsequent bonding of the complete module to a cold plate.

At the same time, the use of the Cu frame ensures that only Cu, and not Mo or Invar are exposed to the interior of the vapor chamber heat spreader. This minimizes the potential for non-condensible gas formation and degradation in performance.

Because the externally facing surfaces of the substrate are mostly Cu, they can be chemically activated and plated for subsequent soldering to a ring frame wall and RF and DC feedthroughs.

Figure 3A:
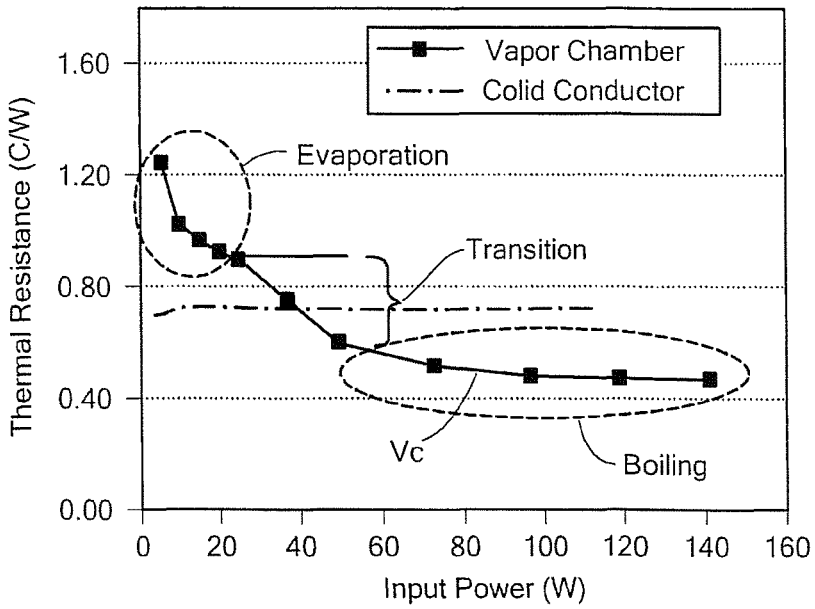
FIG. 3A Prior Art
FIG. 3A is a graphical representation of input power versus thermal resistance for a prior art vapor chamber with a solid conductor.

FIG. 3A is a graphical representation of thermal resistance versus input power for a vapor chamber VC and a solid conductor SC. As can be seen, at relatively low input power, the thermal resistance of the vapor chamber will be relatively high. As more heat (input power) is applied, there is a transition region until boiling occurs. At boiling, the thermal resistance of the vapor chamber is low and relatively constant.

Figure 3B:
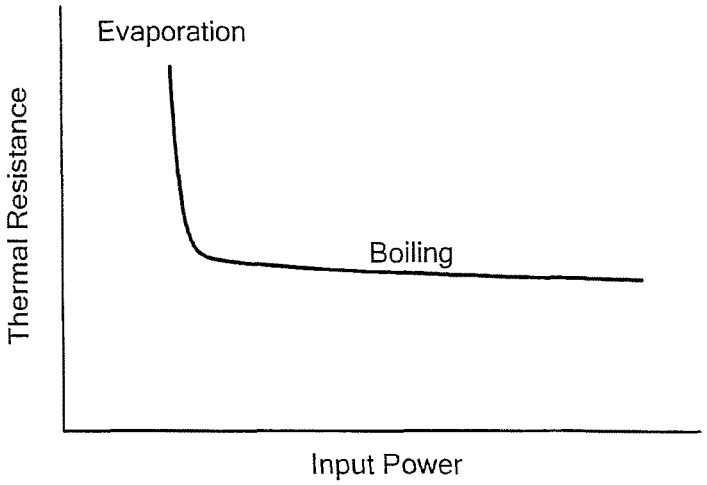
FIG. 3B is a graphical representation of performance of a vapor chamber having a wick coated with carbon nanotubes.

FIG. 3B shows an ideal graphical representation from evaporation to boiling. The transition region is very short due to the rapid transition from evaporation to boiling. Upon reaching a given input power, boiling becomes dominant and resistance is minimized.

FIG. 3C is a graphical representation of heat flux versus substrate temperature for a non-functionalized monolithic wick MW and a monolithic copper wick coated with carbon nanotubes CW. The uncoated monolithic wick MW suffers from 'incipience overshoot'. That is, during the transition from evaporation to boiling, the temperature difference between the wick substrate and vapor must increase to a certain level prior to initiating boiling, at which point the resistance drops significantly. In addition, the electronic package gets hotter for the uncoated wick MW than the coated wick CW before the evaporator transitions to the boiling region. The wick coated with carbon nanotubes CW provides relatively linear performance as the substrate temperature rises due to the incipient boiling generated by the wick structure. The coated wick CW also keeps the devices cooler than the uncoated wick MW during incipience overshoot. The occurrence of the transition to boiling is a function of multiple factors including operating temperature. When the vapor in the vapor chamber is colder, this process tends to occur at a higher heat inputs. Thus, it is desirable to be able to control the boiling transition process to occur at a lower heat input in order to have the widest applicability to applications that require operation at both high and low temperatures. The incipient boiling from the inventive wick structure CW improves the performance of the vapor chamber heat spreader.

Example

Evaporator and condenser substrates of 508 μm-thick laminated 13% Cu/74% Mo/13% Cu and a 2 mm thick Cu frame were coupled together, such as by brazing or soldering, to comprise a hermetic 3 cm×3 cm×3 mm vapor chamber. Cu powder particles were sintered to the evaporator substrate in a tube furnace, resulting in a 1 mm thick wick with an approximate effective pore radius of 23.5 μm, porosity of 0.5 and permeability of 9.45E-12 $m^2$. Four posts were fabricated on the evaporator substrate and were coated with wick to both provide mechanical support against pressure imbalance and to provide liquid return from the condensing surface to the evaporator.

A subset of evaporator and condenser samples of varying types was functionalized with carbon nanotubes (CNTs). CNT-functionalization was started by e-beam evaporation of a tri-m layer (30 nm Ti/10 nm Al/5 nm Fe) catalyst. In some evaporator samples a shadow mask was used to localize the deposition of the catalyst to a roughly 10 mm×10 mm square area centered in the evaporator where the high heat flux load is applied. Subsequent microwave plasma growth of CNTs in 20% CH4 at 900° C. for 10 minutes with 300 W of plasma power and 200V of DC bias was conducted.

The CNT growth process typically resulted in a vertically aligned CNT array with a typical height of 20-30 μm and approximate number density of $2.5\times10^8$ CNTs/cm$^2$. FIG. 3D shows magnified post-CNT growth 150 and FIG. 3E shows further magnification of the growth 150. Exemplary processes and equipment for growing the CNT array is shown and described in B. A. Cola, J. Xu, C. Cheng, X. Xu, T. S. Fisher, and H. Hu, "Photoacoustic Characterization of Carbon Nanotube ArrayThermal Interfaces," Journal of Applied Physics, vol. 105, 54313, 2007, which is incorporated herein by reference.

CNTs, which are generally hydrophobic, were conformally coated with approximately 750 nm of evaporated Cu using e-beam evaporation. Water droplet tests were performed to confirm the hydrophilic nature of these Cu-coated CNTs.

Following the completion of CNT-growth and (as required) Cu coating, samples were subsequently integrated into vapor chamber assemblies as previously described. The vapor chamber assemblies were subsequently evacuated and charged with varying quantities of degassed purified water using standard charging equipment.

Figure 4:
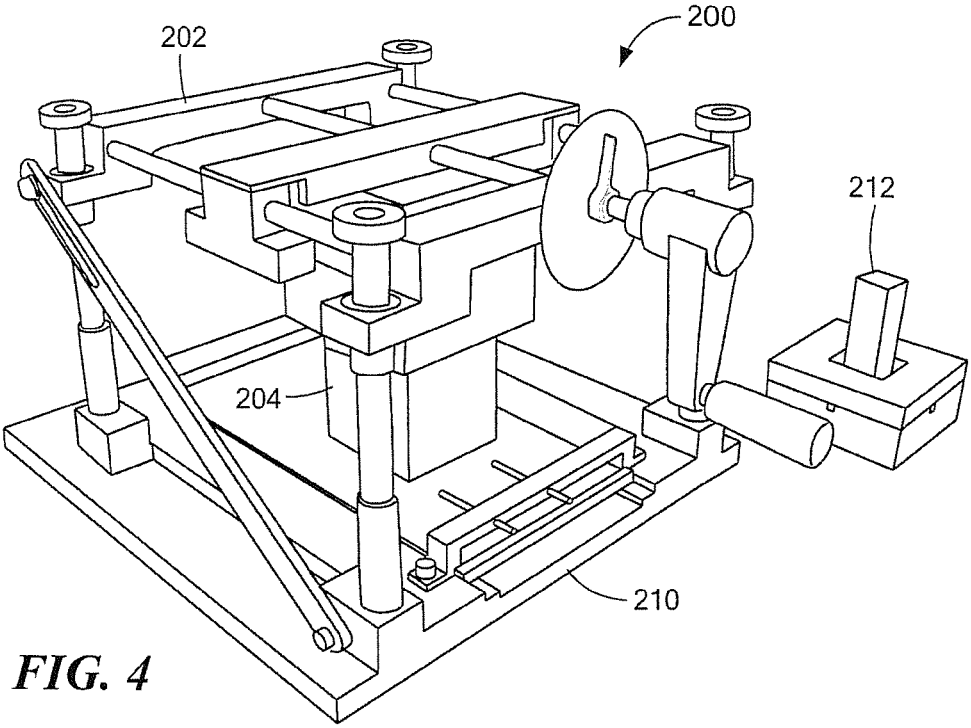
FIG. 4 shows an exemplary test apparatus for a heat spreader in accordance with exemplary embodiments of the invention.

Vapor chamber performance testing was conducted using a one-dimensional steady state heat spreader test facility capable of providing up to 800 W/cm$^2$ of heat input over a 5 mm×5 mm area. FIG. 4 shows an exemplary heat spreader facility 200 having a translating carriage 202 for manipulating an assembly 204 comprising a heater, a sensor array, and a pressure application system. The facility 200 further includes a cold plate 210 and a heater block 212.

The moveable carriage 202 allows the 5 mm×5 mm load to be precisely and repeatedly located anywhere on the 10 cm×20 cm area. The test facility 200 utilizes four cartridge heaters 204 inserted in a copper heater block 214 to deliver heat to the heat spreader under test. Heat flow through the copper heater block 214 was determined using linear regression analysis from three in-line type-T immersion probe-style thermocouples inserted into the Cu block. Temperature of the top surface of the vapor chamber under test was sensed by a thermocouple made from special limits of error (SLE) thermocouple wire that was insulated from the Cu block with a small ceramic tube and made physical (and electrical) contact to the Cu surface through a thin layer of Shin-etsu X23-7762 thermal grease.

Exemplary embodiments of inventive vapor chambers under test were interfaced to a 3 mm thick Cu thermocouple (TC) block (of the same X-Y dimensions) and then to a vacuum brazed Aluminum cold plate with a serpentine flow path containing lanced and offset convoluted fins. A mixture of propylene glycol and water delivered at nominally 20 degrees Celsius was used as the coolant. 508 μm thick Bergquist 5000S35 gap pads were used to interface the vapor chamber to the TC block and TC block to cold plate. We note that the Bergquist gap pad was selected for experimental consistency reasons, as well as for performance commonality with various film-adhesive TIMs used to bond low CTE (e.g. CuMo) heat spreaders to high CTE (Al) cold plates. Twelve type T SLE thermocouples were located in the TC block holes to measure temperature at various locations just below the heat spreader under test. Lastly, an electrical-continuity based 4-post alignment device was used to ensure the 5 mm×5 mm heat input was well aligned to the surface of the heat spreader.

Heat spreader tests were conducted by incrementally increasing the delivered power to the heat spreader under test and allowing the facility to reach thermal steady state, defined as less than 0.1° C. change in the heat spreader evaporator surface over the course of 3 minutes. Typical time to reach steady state was 45 minutes. Heater current, voltage and inlet and outlet coolant temperature were also monitored.

Figure 5:
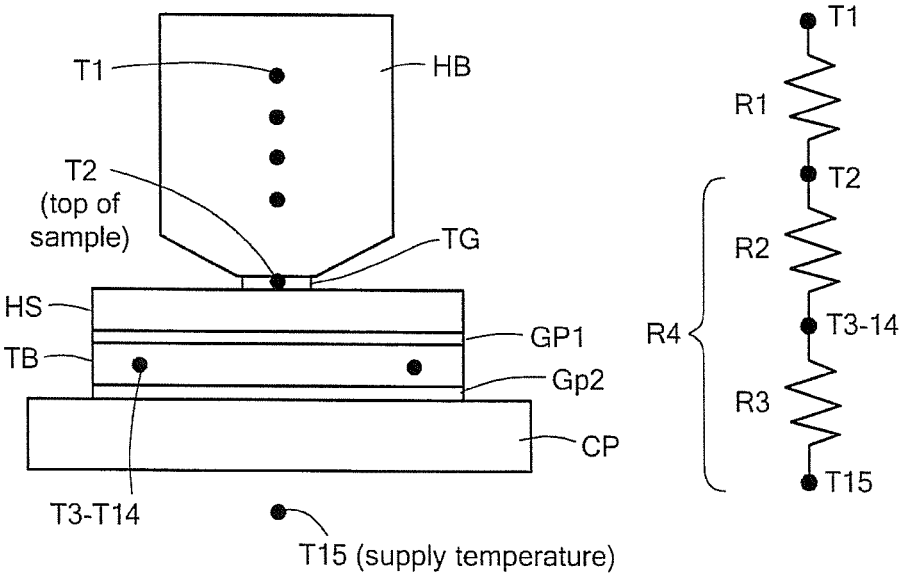
FIG. 5 is a schematic representation of the set up for the apparatus of FIG. 4.

FIG. 5 shows four characteristic temperature resistances R1, R2, R3, and R4 (R2+R3) for the tested samples. The test arrangement shows a heater block HB with thermal grease TG providing an interface with a heat spreader HS. A first gap pad GP1 is sandwiched between the heat spreader HS and a thermocouple block TB and second gap pad GP2 is sandwiched between the thermocouple block TB and a cold plate CP.

Temperature data was used to compute the four characteristic resistances R1, R2, R3, R4 for each experiment. Heat flow uncertainty was computed using the method of Brown, Steele and Coleman, see, e.g., K. K. Brown, H. W. Coleman and W. G. Steele, "Estimating Uncertainty Intervals for Linear Regression," Proceedings of the 33rd American Institute of Aeronautics and Astronautics Aerospace Sciences Meeting and Exhibit, Reno, Nev., 1995, which is incorporated herein by reference. Overall uncertainty on measured thermal resistance was determined using the method of Cline and McClintock, see, e.g., S. J. Kline, and F. A. McClintock: "Describing Uncertainties in Single-Sample Experiments," Mech. Eng., p. 3-8, January 1953, which is incorporated herein by reference. SLE thermocouple error was taken as ±0.5° C.

For the conducted experiments the four characteristic resistances R1, R2, R3, R4 were computed and compared. Each sample was tested multiple times to confirm repeatability.

Owing to the lack of bond line thickness (BLT) control at the heater block-heat spreader interface this resistance showed the most variation, ranging from 0.5-1.0 C/W; however, this variability was of no consequence in that the temperature drop across the thermal grease was not included in R2 and R4, which were of primary interest. Nonetheless, for each experiment attention was paid to the consistency of R1 with increasing power as early experiments revealed that thermal growth of the heater block, coupled with imperfect alignment over a small heat input area could cause non-uniform heating and invalidate test data.

Resistances R2 and R3 were computed by averaging thermocouples 3-14, which were placed symmetrically in drilled holes located around the periphery of the TC block. Resistance R3, which was comprised of conduction through the TC block TB, second gap pad GP2 and cold plate CP was observed to range from 0.15-0.25 C/W, presumably varying with gap pad compression (load varied from 1-2.5 lb from run-to-run and within a run could vary 1 lb due to expansion of the heater block). We observed that R2 and R4 were generally offset by a consistent value from R3, except at the lowest heating conditions for which experimental uncertainty was greatest. As such, results for R2, which includes the heat spreader under test, gap pad and one half of the TC block are reported in the following sections.

Figure 6:
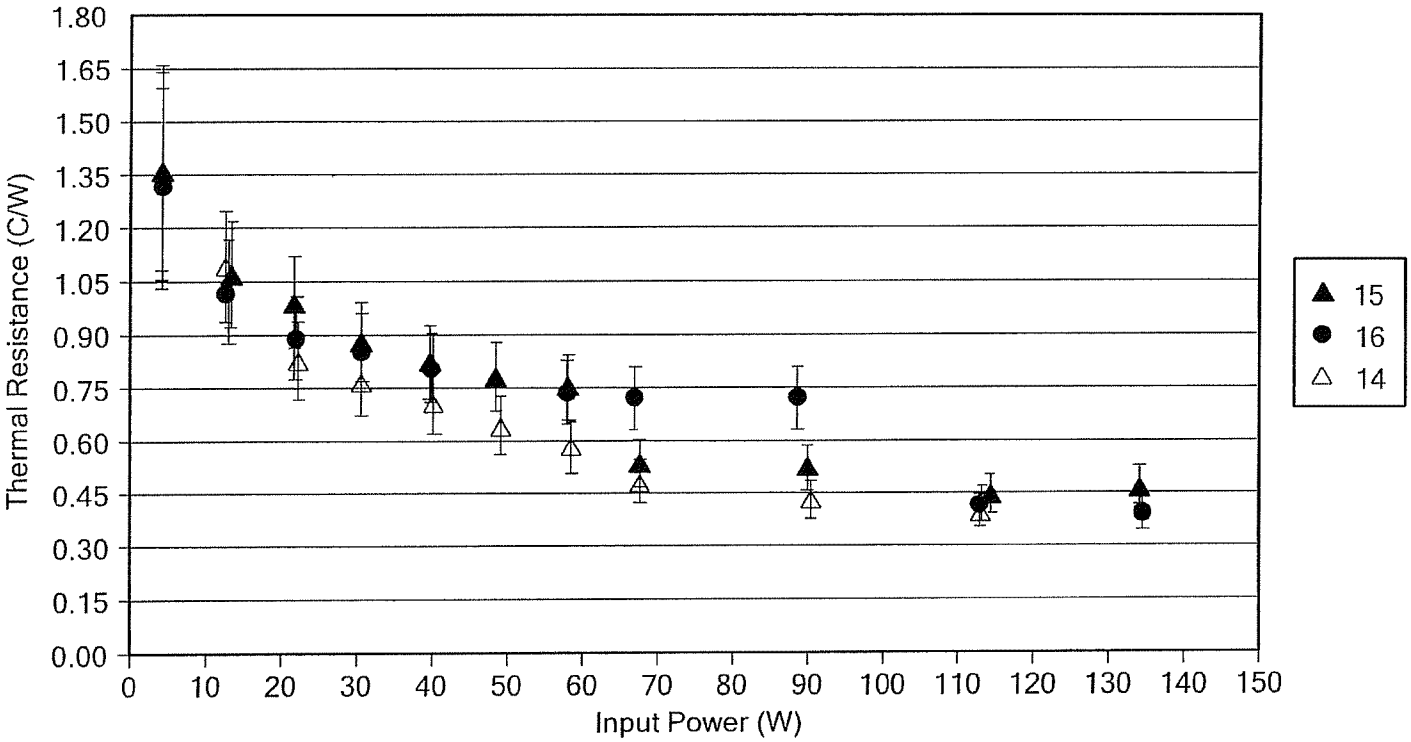
FIG. 6 is a graphical representation of thermal resistance versus input power.

FIG. 6 shows thermal resistance versus input power for samples 14, 15, and 16. Samples 15 and 16 have uncoated wicks and sample 14 has a wick coated with carbon nanotubes. As can be seen, sample 14 has lower thermal resistance than the uncoated samples.

As noted above, our results indicate that ensuring boiling dominated conditions within the evaporator of a given sample obtains low evaporator resistance, and hence, high thermal performance. We believe this is the result of boiling heat transfer 'shorting out' the resistance associated with conduction through the relatively low conductivity liquid-filled porous wick, as shown in FIG. 7.

Figure 7:
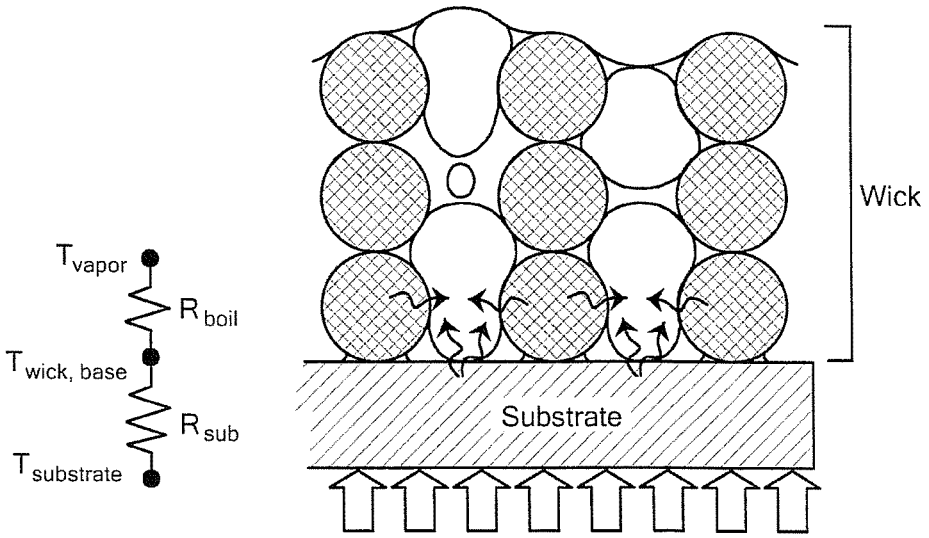
FIG. 7 is a schematic representation of boiling in a vapor chamber and thermal resistances.
Figure 7A:
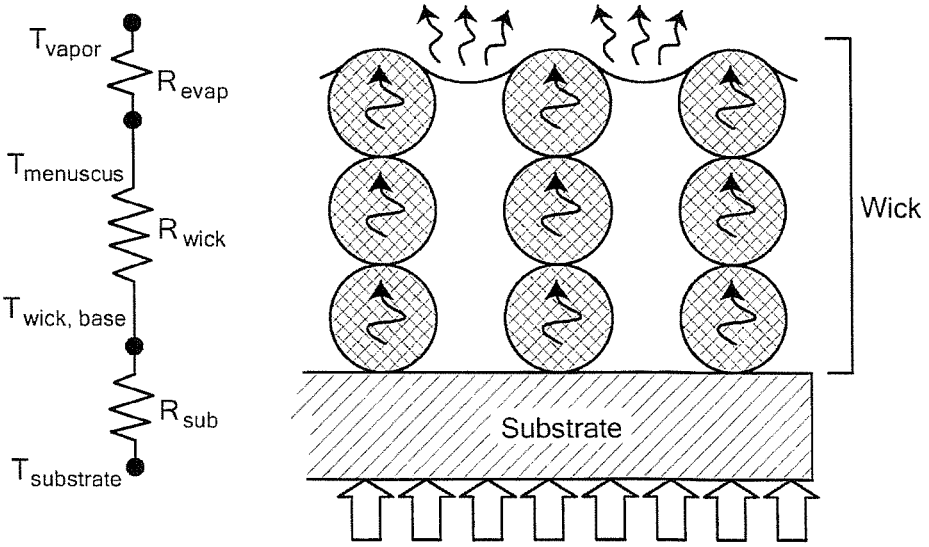
FIG. 7A is a schematic representation of evaporation in a vapor chamber and thermal resistances.

FIG. 7A shows the thermal resistances associated with evaporation. Heat is applied to a substrate SB above which there is a liquid LI. The thermal resistances of the substrate $R_{sub}$, the wick $R_{wick}$, and evaporation $R_{evap}$, define the characteristic resistances of an evaporation-dominated environment. Evaporation is prevalent under lower heating conditions and operating temperatures than boiling. Evaporation is characterized by vaporization from a fixed liquid meniscus to which heat must be conducted through the liquid-filled wick.

FIG. 7 shows the thermal resistances associated with boiling. The thermal resistances of the substrate $R_{sub}$ and boiling $R_{boil}$ define the characteristic resistances of a boiling-dominated environment. Boiling is prevalent under higher heating conditions and higher operating temperatures than evaporation. Boiling is characterized by spontaneous vapor formation (bubble nucleation) within the wick. Vapor bubbles due to boiling heat transfer 'shorts out' thermal resistance of conduction through the wick. Boiling heat transfer improves with applied flux and reduces thermal resistance.

Figure 8:
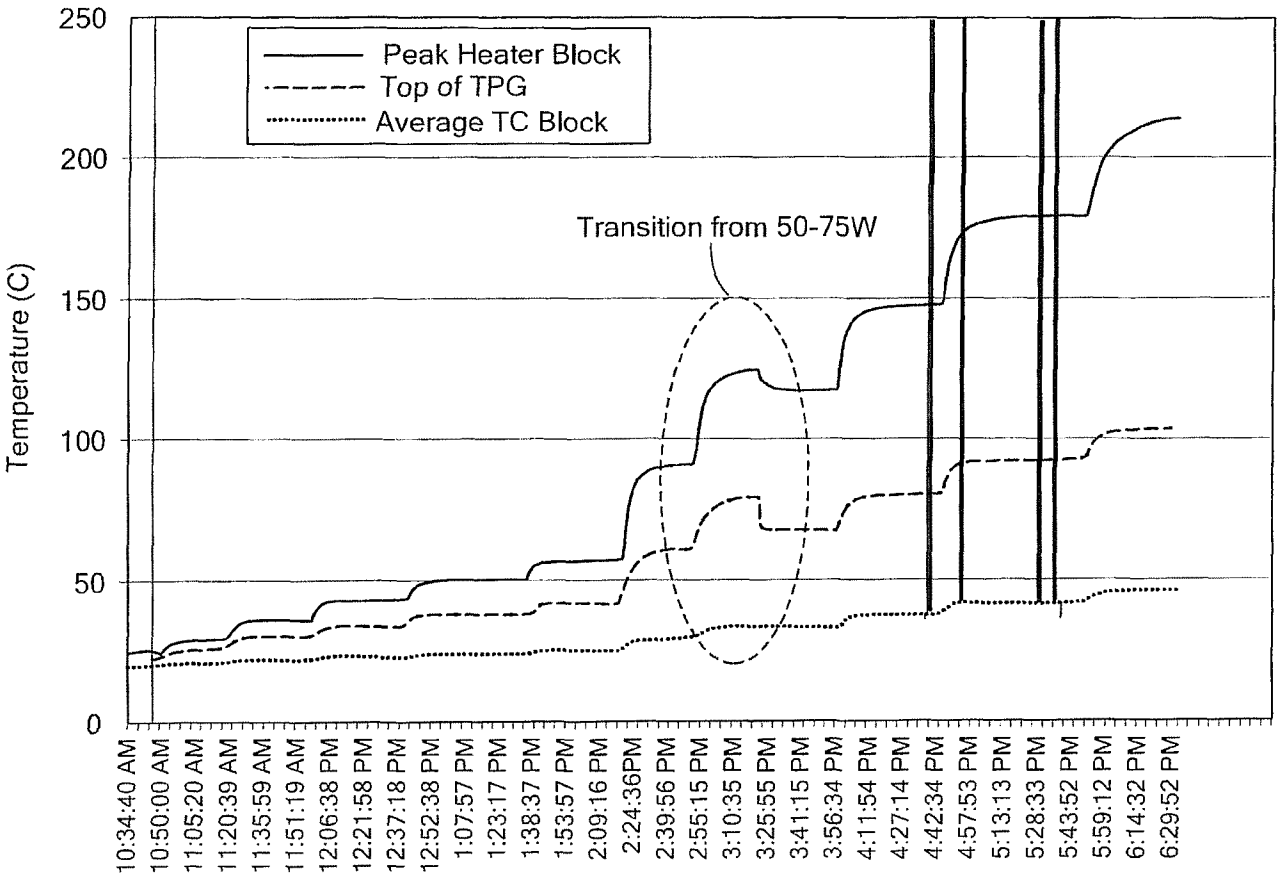
FIG. 8 is a graphical representation of the temperature drop at boiling incipience.

Previous investigations into incipient boiling in quiescent fluid found it to be a probabilistic process dependent upon many variables including fluid condition and surface chemistry. To better understand how this translates to our configuration we compiled incipience data for all tests conducted where a clear incipient boiling related temperature drop was observed, as shown in FIG. 8. This data included applied heat flux, mounting surface temperature and evaporator temperature. Given that this transition occurs under transient conditions under which our regression-based heat flow measurement technique would not strictly apply, no attempt was made to determine the precise incipient heat flux, but rather an average of the steady state heat fluxes of the data point taken prior to and following the temperature drop was used.

When plotting the incipient heat flux against mounting surface temperature we observed that for an effectively constant mounting temperature of ~25° C. incipient heat flux varied from roughly 100-400 W/cm$^2$. For the elevated mounting temperature condition tests (~50° C. mounting temperature), boiling incipience occurred consistently at ~80 W/cm$^2$. We also plotted estimated evaporator superheat ($T_{evap}-T_{sat,est}$) vs. incipient heat flux. Saturation temperature was estimated through resistance network analysis from the measured thermocouple block temperature at the average incipient heat flux. Again, we observed substantial spread in the data with incipient superheats varying from 20 to 75° C.

Figure 9:
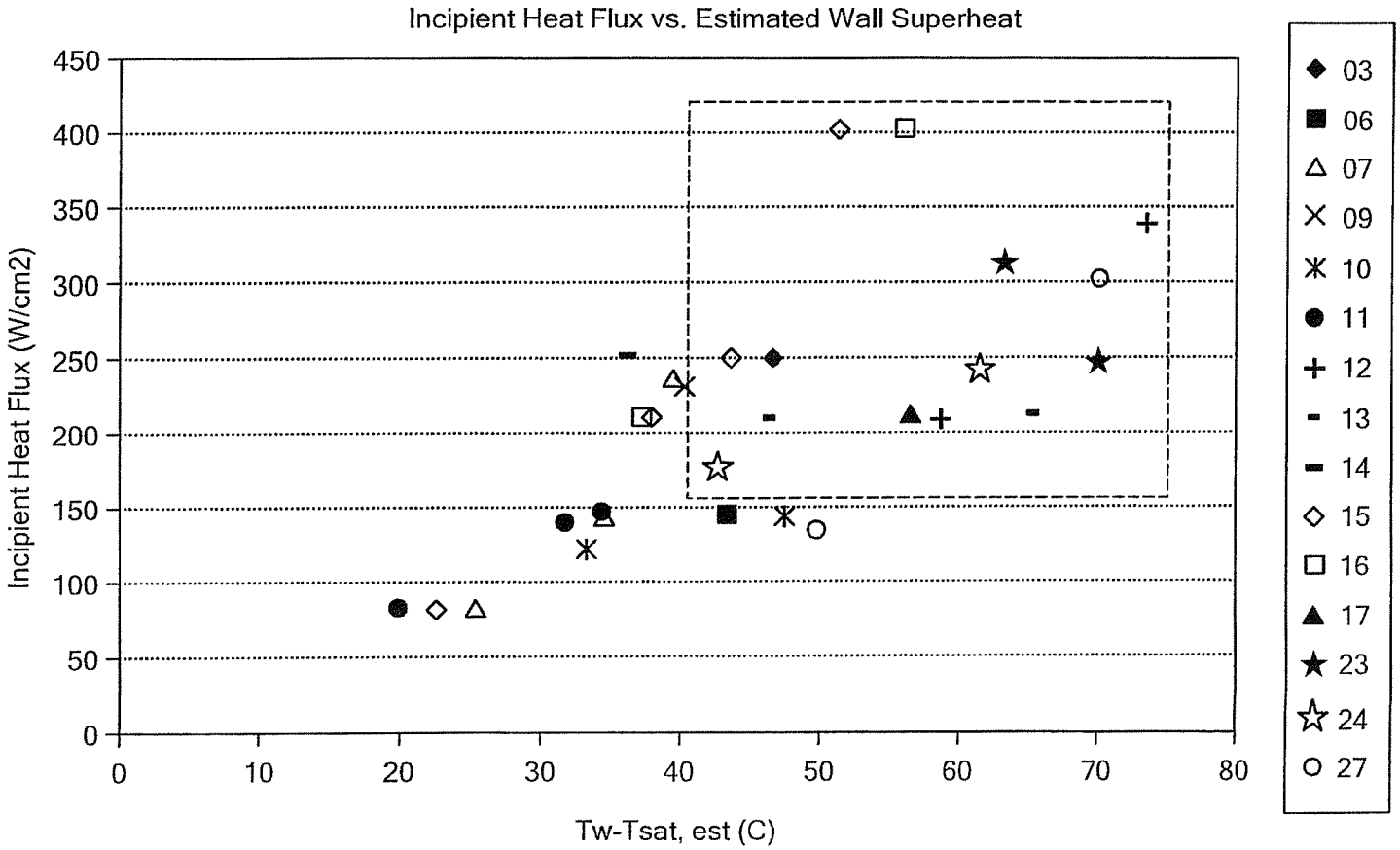
FIG. 9 is a graphical representation of incipient heat flux versus estimate wall superheat.

As shown in FIG. 9, we noticed that the extremely high incipient heat fluxes and superheats were only observed for the samples without CNT-functionalized evaporators, while all of the samples with CNTs tended to exhibit lower incipient heat flux and superheat. That is, CNT functionalization shifts incipience characteristics in complete samples.

The following summarizes the above. Exemplary embodiments of the invention provide low-CTE vapor chamber heat spreaders for cooling high heat flux generating emergent and next-generation semiconductor devices. For small, high heat flux heat spreading configuration evaporator thermal resistance dominates overall vapor chamber thermal resistance. Ensuring boiling-dominated heat transfer in the evaporator wick structure minimizes evaporator (and thus overall thermal resistance). CNT-functionalization 'shifts' incipient heat flux and wall superheat. Sample thermal resistance appears sensitive to operating temperature and operating temperature appears to play a significant role in boiling incipience. Thus, for a given temperature CNTs can be used to minimize evaporator, thus overall thermal resistance.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A heat spreader system, comprising:
- a vapor chamber;
- a fluid in the vapor chamber;
- a wick disposed in the vapor chamber, the wick comprising a metal wick structure; and
- a coating disposed over one or more surfaces of the wick, the coating comprising carbon nanotubes for promoting incipient boiling of the fluid.

2. The system according to claim 1, where the vapor chamber comprises a frame, a cover and a base, wherein the frame is formed from a first material having a first coefficient of thermal expansion (CTE) and the cover is formed form a second material having a second CTE, wherein the first CTE is greater than a reference CTE and the second CTE is less than the reference CTE.

3. The system according to claim 2, wherein the frame comprises copper.

4. The system according to claim 2, wherein the cover comprises a multi-layer laminate.

5. The system according to claim 4, wherein the laminate layers comprise a first layer comprising copper and a second layer comprising molybdenum.

6. The system according to claim 1, wherein the vapor chamber has a composite CTE matched to a CTE of a substrate for circuitry.

7. The system according to claim 6, wherein the CTE of the substrate corresponds to GaAs.

8. The system according to claim 1, wherein the wick is bi-porous.

9. The system according to claim 1, wherein the wick comprises sintered copper particles.

10. The system according to claim 1, wherein interior surfaces of the vapor chamber are copper.

11. A heat spreader system, comprising:
- a vapor chamber;
- a fluid in the vapor chamber;
- a wick disposed in the vapor chamber, the wick comprising a metal wick structure; and
- a coating disposed over one or more surfaces of the wick, the coating comprising carbon nanotubes for decreasing thermal resistance of the wick and increasing throughput of the fluid through the wick to promote incipient boiling of the fluid within the wick.

12. The system according to claim 11, wherein the wick is bi-porous.

13. The system according to claim 11, wherein the wick comprises sintered copper particles.

* * * * *